US005808229A

United States Patent [19]

Bastian et al.

[11] Patent Number: 5,808,229

[45] Date of Patent: Sep. 15, 1998

[54] NON-TILT BARREL FOR A SEMI-AUTOMATIC HANDGUN

[76] Inventors: Englebert Bastian, 870 Pearl Dr., Lenoir City, Tenn. 37772; Edward Asbury, 5709 Haynes Sterchi Rd., Knoxville, Tenn. 37912

[21] Appl. No.: 789,648

[22] Filed: Jan. 27, 1997

[51] Int. Cl.[6] ..... F41A 5/04

[52] U.S. Cl. ..... 89/163; 89/128

[58] Field of Search ..... 89/163, 162, 194, 89/195, 196, 128

[56] References Cited

U.S. PATENT DOCUMENTS

| | | | |
|---|---|---|---|
| 1,355,423 | 10/1920 | Pederson | 89/196 |
| 2,975,680 | 3/1961 | Wilson | 89/196 |
| 4,127,056 | 11/1978 | Kart | 89/128 |
| 4,176,584 | 12/1979 | Thomas, Jr. | 89/190 |
| 4,201,113 | 5/1980 | Seecamp | 89/163 |
| 4,358,987 | 11/1982 | Wilhelm | 89/196 |
| 4,580,484 | 4/1986 | Moore | 89/128 |
| 4,854,217 | 8/1989 | Ransom | 89/163 |
| 5,325,617 | 7/1994 | Vojta et al. | 42/75.03 |

FOREIGN PATENT DOCUMENTS

| | | | |
|---|---|---|---|
| 673028 | 5/1952 | United Kingdom | 89/163 |

*Primary Examiner*—Stephen M. Johnson

*Attorney, Agent, or Firm*—Pitts & Brittain, P.C.

[57] ABSTRACT

An improved non-tilt barrel for converting a conventional semi-automatic weapon from having a pivoting linkage between the barrel and the receiver to a weapon having a cam in order to reduce the recoil of the weapon and to increase the accuracy of the weapon. Further, the non-tilt barrel is provided for increasing the distance of travel of the barrel during recoil to, in turn, increase the time of lockup between the barrel and the slide during the firing of a cartridge. As a result of the modifications resulting in the non-tilt barrel, internal pressures are reduced during the unlocking of the barrel and slide, thereby accomplishing a longer life for each component, and especially the recoil buffer pad. The position of the slide stop on a conventional firearm is moved slightly up and toward the rear of the gun. The length of the slide stop lever is varied accordingly such that engagement with the slide stop plunger is maintained in conventional fashion. The slide is also modified to define the breech at a more forward position. The barrel is modified by removing the barrel link mounting bracket, the barrel link, and the barrel link pin. The receiver is also shortened in similar fashion to accommodate the longer barrel travel. The feed ramp of the conventional firearm is removed, thereby defining a smooth barrel bed. An encircling cam is mounted in place of the barrel link assembly and defines a first leg having a length to allow the barrel to recoil as a bullet is fired, with the direction of recoil being substantially in the opposite direction of the travel of the bullet.

2 Claims, 3 Drawing Sheets

NON-TILT BARREL FOR A SEMI-AUTOMATIC HANDGUN

TECHNICAL FIELD

This invention relates to the field of firearms. More specifically, the present invention relates to an improved barrel for a semi-automatic firearm wherein the barrel is not tilted during the expulsion of the bullet, thereby reducing kick and improving accuracy of the firearm.

BACKGROUND ART

In the field of semiautomatic weapons, it is well known that substantial recoil can be a result of firing a weapon. A portion of the recoil is due to the mechanism within the firearm for allowing the spent casing to be ejected and the next bullet to be loaded into the breech. A further undesirable result of such mechanisms is reduced accuracy.

As a result of the deficiencies in this type of weapon, several variations of mechanisms have been developed. Typical of the art are those devices disclosed in the following U.S. patents:

| U.S. Pat. No. | Inventor(s) | Issue Date |
|---|---|---|
| 2,975,680 | G. A. Wilson | Mar. 21, 1961 |
| 4,127,056 | F. H. Kart | Nov. 28, 1978 |
| 4,358,987 | G. Wilhelm | Nov. 16, 1982 |
| 5,325,617 | M. Vojta, et al. | July 5, 1994 |

The '056 device disclosed by Kart most clearly illustrates the current state of the art for a Colt Model 1911 style automatic loading pistol. FIGS. 1, 3 and 5 of the present application also illustrate the well-known weapon. The particular point of interest in this prior art weapon is the linkage between the barrel and the receiver. As illustrated by Kart in FIG. 3 of the '056 patent, a barrel link is pivotally mounted to the barrel using a barrel link pin. As the barrel recoils after a round has been fired, because it is pivotally mounted, the barrel instantaneously begins to change its direction, thus changing the trajectory of the bullet. This movement of the barrel is accountable also for at least a portion of the recoil of the weapon.

Wilhelm ('987) also discloses a device for mounting a barrel onto a receiver of a semi-automatic weapon. As illustrated in FIGS. 17 and 18 of the '987 patent, it is clear that the firing position of the barrel and the recoil position of the barrel are at different attitudes. The Wilhelm device defines camming surfaces at either end of a takedown assembly pin, equivalent to the slide stop received by the barrel link described above. However, a relatively short portion of the camming surface for the initial portion of the ejection of the bullet, thereby still creating a trajectory change. Further, it is clear from the illustration that as the weapon is fired, the angle of the barrel with respect to the slide is immediately varied, as a result of the disengagement of the lock protrusion defined by the barrel from the recess defined by the slide.

Neither of these patents discloses a link-less conversion using a fully-encircling cam slot for controlling the tilt of the barrel during recoil. Further, none of these devices requires the removal of the feed ramp in conventional receivers for the passage of the cam during recoil.

Therefore, it is an object of this invention to provide a means for converting a conventional semi-automatic weapon from having a pivoting linkage between the barrel and the slide to a weapon having a cam in order to reduce the recoil of the weapon and to increase the accuracy of the weapon.

It is also an object of the present invention to alter the location of the slide stop and the breech face in order to increase the distance of travel during recoil in order to increase the time of lockup during the firing of a cartridge.

As a result of these objects, it is a further object of the present invention to provide such a device whereby internal barrel pressures are reduced during the unlocking action of the slide and barrel, thereby accomplishing a longer life for each component.

DISCLOSURE OF THE INVENTION

Other objects and advantages will be accomplished by the present invention which is provided for converting a conventional semi-automatic weapon from having a pivoting linkage between the barrel and the receiver to a weapon having a cam in order to reduce the recoil of the weapon and to increase the accuracy of the weapon. Further, the non-tilt barrel of the present invention is provided for increasing the distance of travel during recoil to, in turn, increase the time of lockup during the firing of a cartridge. As a result of the modifications resulting in the non-tilt barrel, internal barrel pressures are reduced during the unlocking action of the slide and barrel, thereby accomplishing a longer life for each component, and especially the recoil buffer pad.

The position of the slide stop on a conventional firearm is moved slightly up and toward the rear of the gun. To accomplish this, the existing slide stop opening defined by the receiver is plugged and a new slide stop opening is formed. The length of the slide stop lever is varied accordingly such that engagement with the slide stop plunger is maintained in conventional fashion. The slide is also modified to define the breech at a more forward position. The barrel is modified by removing the barrel link mounting bracket, the barrel link, and the barrel link pin. The receiver is also machined to accommodate the longer barrel travel. The result of a longer barrel travel is that while the barrel and slide are locked and they are recoiling in a direction opposite the direction of travel of the bullet—while the slide stop pin is engaged within the first leg of the cam—pressure created in reaction to the firing of the bullet is dissipated. Further, the feed ramp of the conventional firearm is removed, thereby defining a smooth barrel bed.

An encircling cam is mounted in place of the barrel link assembly. The cam defines a first leg having a length to allow the barrel to recoil as a bullet is fired, with the direction of recoil being substantially in the opposite direction of the travel of the bullet. After the barrel has traveled the length of the first leg, the barrel disengages from the slide by dropping as the slide stop pin travels through a second leg of the cam. However, because the bullet has exited the barrel prior to the dropping of the barrel, such movement will not effect the trajectory of the bullet. In order to assure that the barrel does not tilt while the bullet is traveling down the barrel, the first leg is ramped up at approximately one degree (1°) with respect to the central axis of the barrel, accounting for the static barrel angle at the moment of firing.

Not only does such a result yield more accurate firing and less recoil to be absorbed by the shooter, but the wear life of the internal components is extended. Especially noticeable is the improved wear life on the recoil buffer pad.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

An improved non-tilt barrel for a semi-automatic handgun incorporating various features of the present invention is illustrated generally at 10 in the figures. The improved non-tilt barrel for a semi-automatic handgun, or non-tilt barrel 10, is designed for converting a conventional semi-automatic weapon 12' from having a pivoting linkage between the barrel 14' and the receiver 26' to a weapon having a cam 50 in order to reduce the recoil of the weapon and to increase the accuracy thereof The location of the slide stop 34' and the breech face 44' of a conventional firearm are modified in order to increase the distance of travel during recoil to, in turn, increase the time of lockup during the firing of a cartridge. As a result of the modifications resulting in the non-tilt barrel 10, internal barrel pressures are reduced during the unlocking action of the slide and barrel, thereby accomplishing a longer life for each component, and especially the recoil buffer pad 46.

Figure 1:
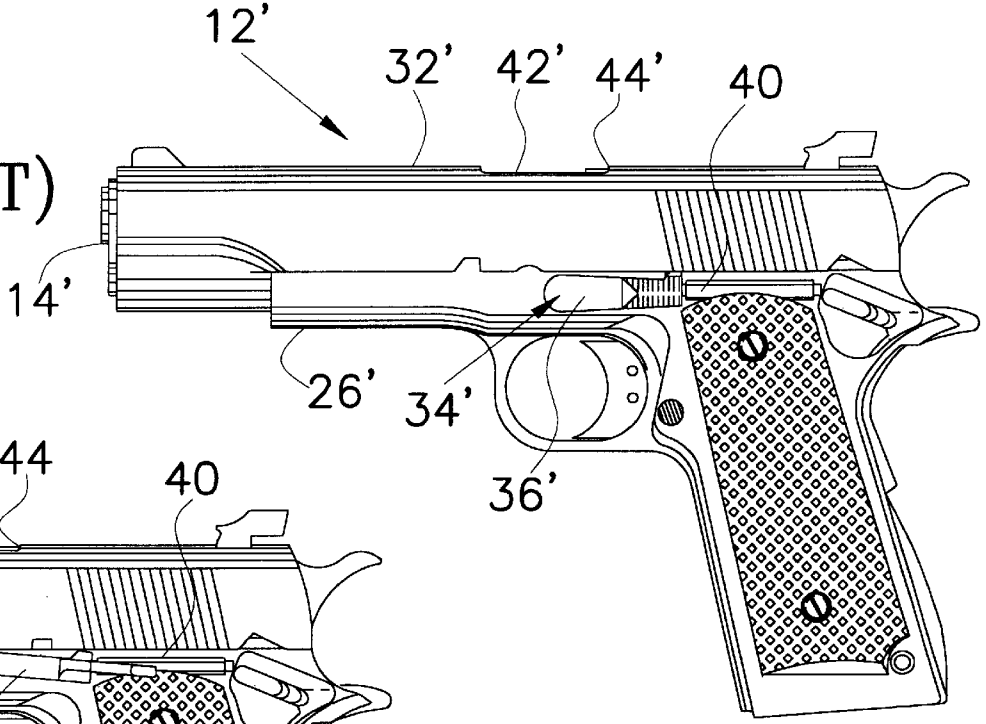
Fig.1 (PRIOR ART)
FIG. 1 is a side elevation view of a prior art semi-automatic handgun.
Figure 2:
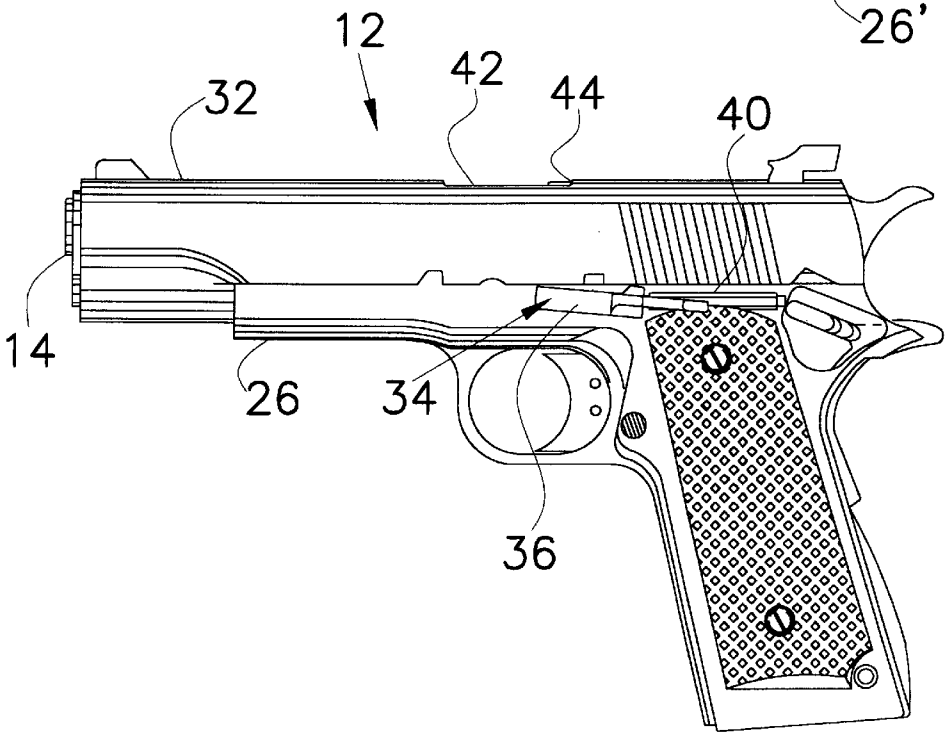
FIG. 2 is a side elevation view of the improved non-tilt barrel for a semi-automatic handgun constructed in accordance with several features of the present invention.
Figure 3:
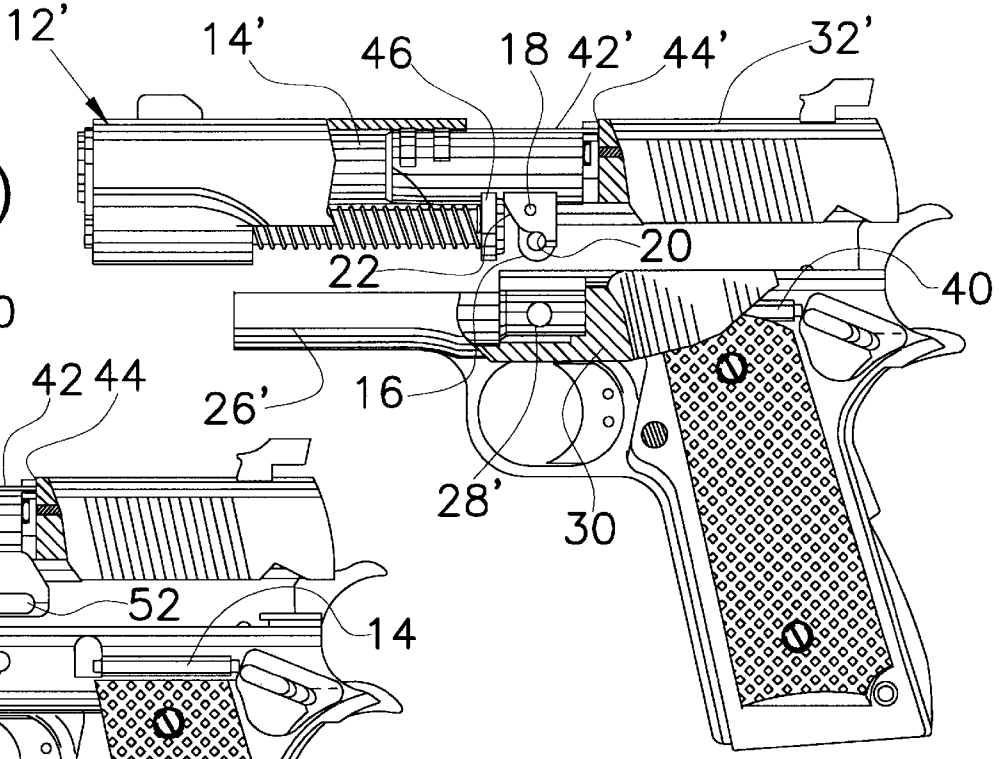
Fig.3 (PRIOR ART)
FIG. 3 is a partially exploded side elevation view of the prior art semi-automatic handgun illustrated in FIG. 1.
Figure 4:
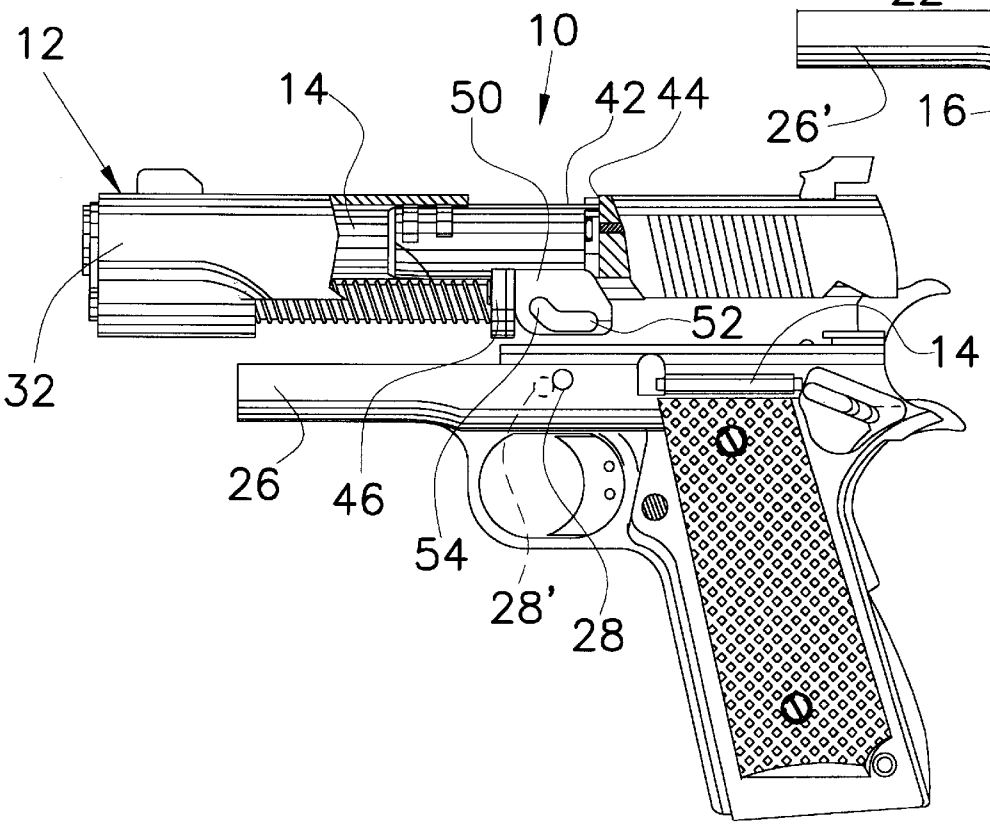
FIG. 4 is a partially exploded side elevation view of the improved non-tilt barrel for a semi-automatic handgun illustrated in FIG. 2.
Figure 5:
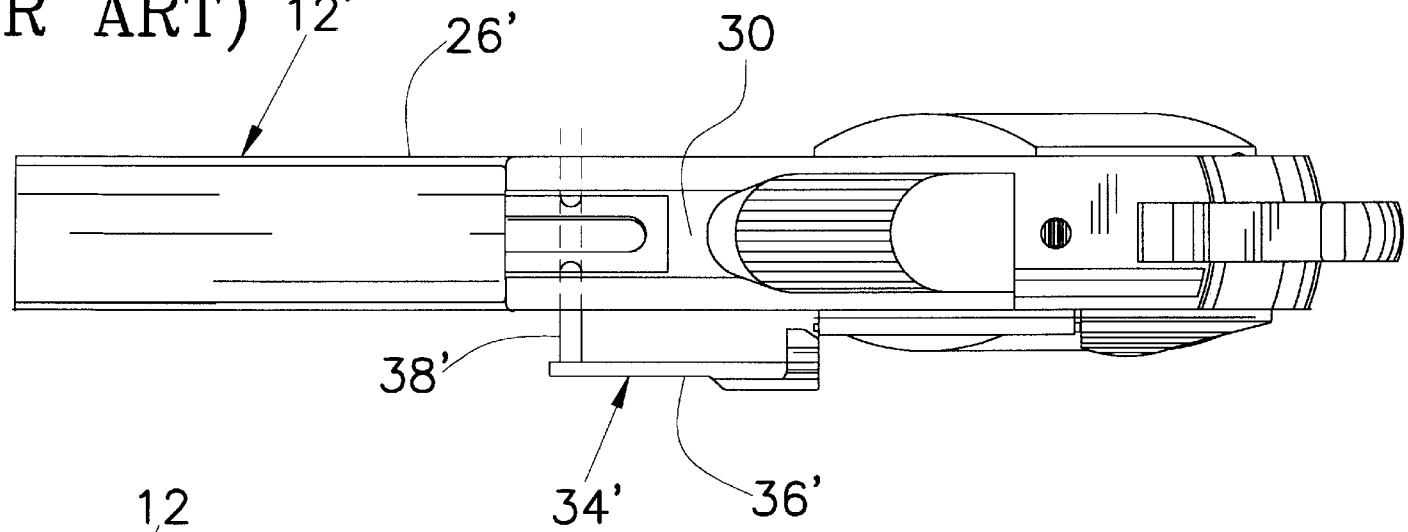
Fig.5 (PRIOR ART)
FIG. 5 is a top plan view of the receiver of the prior art semi-automatic handgun illustrated in FIG. 1.
Figure 6:
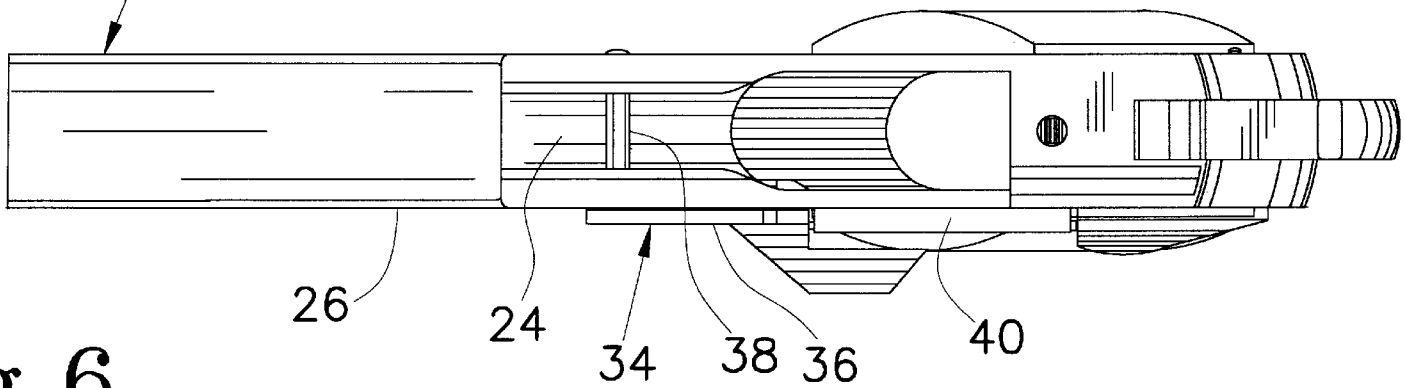
FIG. 6 is a top plan view of the receiver of the improved non-tilt barrel for a semi-automatic handgun illustrated in FIG. 2.

FIGS. 1, 3 and 5 illustrate a prior art semi-automatic handgun 12' while FIGS. 2, 4 and 6 illustrate a firearm 12 incorporating the non-tilt barrel 10 of the present invention. These figures are shown adjacent each other for comparison between the two. It will be understood that while discussion is centered around modification of a conventional weapon 12', it is intended that the present invention not be limited solely to the method of modifying of a conventional weapon 12', but is intended to encompass the modified weapon 12 as well. Further, discussion is centered on the modification of a Colt Model 1911 automatic loading pistol. It will be understood that various other models similar in structure and operation may be similarly adapted, and that dimensions will be varied accordingly.

FIG. 1 illustrates a side elevation view of a conventional semi-automatic firearm 12'. Of interest in this particular view is the location of the slide stop 34' and the breech 42'. Illustrated in FIG. 2 is a firearm 12 incorporating the non-tilt barrel 10 of the present invention. As can be more clearly seen in FIG. 4, the relative position of the slide stop 34 has been moved slightly up and toward the rear of the gun 12. For clarification, the rear of the gun 12 is herein defined as the stock end. For a Colt Model 1911, the slide stop 34 is moved approximately 0.190 inches toward the rear and approximately 0.060 inches up. More specifically, the existing slide stop opening 34' defined by the receiver 26' is plugged and a new slide stop opening 34 is formed. The length of the slide stop lever 36 is varied accordingly such that engagement with the slide stop plunger 40 is maintained in conventional fashion. The slide 32 is also modified to define the breech 42 at a more forward position, as discussed more thoroughly below.

FIGS. 3 and 4 more clearly illustrate the linkage of the prior art and the cam 50 of the present invention. In the prior art device illustrated in FIG. 3, a barrel link 16 is pivotally mounted on the barrel 14' via a barrel link pin 18. An opening 20 defined in the barrel link pin 18 is provided for receiving the pin portion 38 of the slide stop 34', which is received through openings 28' defined on either side of the receiver 26'. A feed ramp 30 is defined within the receiver 26' for housing the linkage assembly. In the present invention as illustrated in FIG. 4, the barrel 14 is modified by removing the barrel link mounting bracket 22, the barrel link 16, and the barrel link pin 18. Further, the feed ramp 30 of the conventional firearm 12' is removed, thereby defining a smooth barrel bed 24, as illustrated in FIG. 6. Removal of the feed ramp 30 is accomplished by any conventional method such as grinding or milling.

A cam 50 is mounted in place of the barrel link assembly. The cam 50 defines a first leg 52 having a length to allow the barrel 14 to recoil as a bullet (not shown) is fired, with the direction of recoil being substantially in the opposite direction of the travel of the bullet. After the barrel 14 has traveled the length of the first leg 52, the barrel 14 disengages from the slide 32 by dropping as the slide stop pin 34 travels through a second leg 54 of the cam 50. However, because the bullet has exited the barrel 14 prior to the dropping of the barrel 14, such movement will not effect the trajectory of the bullet. In order to assure that the barrel 14 does not tile while the bullet is traveling down the barrel 14, the first leg 52 is ramped up at approximately one degree (1°) with respect to the central axis of the barrel 14, accounting for the static barrel angle at the moment of firing. The length of the first leg 52 in the continuing example is approximately 0.250 inches. The diameter of the slide stop pin 38 and openings 28 are accordingly varied to be closely received within the cam 50.

The slide 32 is modified by moving the breech 42 forward, thus increasing the distance the barrel 14 travels in recoil. The breech face 44' of a conventional firearm is 2.17 inches from the rearward end of the slide. However, in the present invention, the slide 32 is modified by moving the breech 42 forward approximately 0.237 inches such that the breech face 44 is approximately 2.407 inches from the rearward end of the slide 32. The receiver 26 is also machined to accommodate the longer barrel travel. The result of a longer barrel travel is that while the barrel 14 and slide 32 are locked and they are recoiling in a direction opposite the direction of travel of the bullet—while the slide stop pin 38 is engaged within the first leg 52 of the cam 50—pressure created in reaction to the firing of the bullet is dissipated.

Not only does such a result yield more accurate firing and less recoil to be absorbed by the shooter, but the wear life of the internal components is extended. Especially noticeable is the improved wear life on the recoil buffer pad 46. In testing, a firearm 12 modified to incorporate the non-tilt barrel 10 of the present invention was fired three hundred (300) times. After testing, the firearm 12 was disassembled and the components were examined. The recoil buffer pad 46 revealed no wear. However, in conventional firearms 12' of the type tested, it is recommended that the recoil buffer pad be replaced after five hundred (500) rounds.

The conversion of a conventional firearm 12' to include the non-tilt barrel 10 of the present invention requires some modification of existing components of the weapon. Such modification will be known to one skilled in the art to include conventional cutting, welding, grinding, and milling techniques. However, some components of the present invention are more economically purchased in a kit. For example, the slide stop 34 and the slide 32 and barrel 14 assembly may be purchased in a kit, leaving only the feed ramp 30 in the receiver 26' to be removed, the length of the receiver 26' to be cut down, and the slide stop openings 28' to be plugged and redrilled. Moreover, it will be understood that a firearm 12 incorporating the non-tilt barrel 10 of the present invention may be manufactured without conversion of a conventional firearm 12'. It is intended that the present disclosure anticipates each of these uses, or a combination thereof, of the subject matter disclosed herein.

From the foregoing description, it will be recognized by those skilled in the art that a improved non-tilt barrel for a semi-automatic handgun offering advantages over the prior art has been provided. Specifically, the non-tilt barrel is retrofit into a conventional semi-automatic weapon originally having a pivoting linkage between the barrel and the slide. The pivoting linkage is replaced a cam, and several dimensions of the firearm are modified in order to reduce the recoil of the weapon and to increase the accuracy of the weapon. The location of the slide stop and the breech face of a conventional firearm are modified in order to increase the distance of travel during recoil in order to increase the time of lockup during the firing of a cartridge. As a result of the modifications resulting in the non-tilt barrel, internal barrel pressures are reduced during the unlocking of the slide and barrel, thereby accomplishing a longer life for each component, and especially the recoil buffer pad.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention,

We claim:

1. A method for converting a semi-automatic handgun, the semi-automatic handgun including a receiver defining a slide stop pin opening on each side thereof for receiving a slide stop pin and a feed ramp on the forward end of a magazine well, a barrel provided with a barrel link pin receptor for receiving a barrel link pin to pivotally mount a barrel link, the barrel link defining an opening for pivotally receiving the slide stop pin, a slide defining a breech, and a slide stop including a lever and the slide stop pin configured to be received through each slide stop pin opening defined by the receiver and the barrel link, said method comprising the steps of:

(A) removing the barrel link pin receptor, the barrel link pin, and the barrel link from the barrel;

(B) mounting a cam slide to the barrel to replace the barrel link pin receptor, said cam slide defining an opening for receiving the slide stop pin;

(C) relocating the slide stop pin openings defined by the receiver;

(D) removing the feed ramp from the receiver; and (E) modifying a length of the slide stop lever such that the slide stop pin is received within each relocated slide stop pin opening and said cam slide opening.

2. A method for converting a semi-automatic handgun, the semi-automatic handgun including a receiver defining a slide stop pin opening on each side thereof for receiving a slide stop pin and a feed ramp on the forward end of a magazine well, a barrel provided with a barrel link pin receptor for receiving a barrel link pin to pivotally mount a barrel link, the barrel link defining an opening for pivotally receiving the slide stop pin, a slide defining a breech, and a slide stop including a lever and the slide stop pin configured to be received through each slide stop pin opening defined by the receiver and the barrel link, said method comprising the steps of:

(A) removing the barrel link pin and the barrel from the semi-automatic handgun;

(B) relocating the slide stop pin openings defined by the receiver;

(C) removing the feed ramp from the receiver;

(D) replacing the barrel with a modified barrel defining a cam slide in lieu of the barrel link pin receptor, said cam slide defining an opening for receiving the slide stop pin;

(E) modifying a length of the slide stop lever such that the slide stop pin is received within each relocated slide stop pin opening and said cam slide opening.

* * * * *